US006527199B1

(12) United States Patent
Schwarz

(10) Patent No.: US 6,527,199 B1
(45) Date of Patent: Mar. 4, 2003

(54) FUEL INJECTION VALVE FOR AN INTERNAL COMBUSTION ENGINE

(75) Inventor: Volker Schwarz, Weinstadt (DE)

(73) Assignee: DaimlerChrysler AG, Stuttgart (DE)

( * ) Notice: Subject to any disclaimer, the term of this patent is extended or adjusted under 35 U.S.C. 154(b) by 45 days.

(21) Appl. No.: 09/653,980

(22) Filed: Sep. 1, 2000

(30) Foreign Application Priority Data

Sep. 4, 1999 (DE) ..... 199 42 291

(51) Int. Cl.[7] ..... B05B 9/00

(52) U.S. Cl. ..... 239/124; 239/127; 239/88; 239/91; 239/92; 123/506

(58) Field of Search ..... 239/124, 127, 239/88, 89, 90, 91, 92, 93, 96, 533.3, 533.4; 123/506, 514, 468; 137/624.14

(56) References Cited

U.S. PATENT DOCUMENTS

| | | | | |
|---|---|---|---|---|
| 3,610,529 A | * | 10/1971 | Huber | 239/96 |
| 4,211,202 A | * | 7/1980 | Hafner | 239/88 |
| 4,852,808 A | | 8/1989 | Yamamoto | |
| 5,056,488 A | * | 10/1991 | Eckert | 239/88 |
| 5,323,964 A | * | 6/1994 | Doszpoly | 239/91 |
| 5,390,851 A | * | 2/1995 | Long et al. | 239/88 |
| 5,464,156 A | * | 11/1995 | Ricco et al. | 239/124 |
| 5,617,998 A | | 4/1997 | Buckley et al. | |
| 5,860,597 A | * | 1/1999 | Tarr | 239/124 |

FOREIGN PATENT DOCUMENTS

| | | |
|---|---|---|
| DE | 33 44 396 | 6/1985 |
| DE | 44 41 603 | 5/1996 |
| DE | 196 12 737 | 10/1998 |
| EP | 0 723 076 | 7/1996 |

OTHER PUBLICATIONS

MTZ Motortechnische Zeitschrift 5791996) 4, FIG. 17.

* cited by examiner

*Primary Examiner*—Lesley D. Morris
*Assistant Examiner*—Dinh Q. Nguyen
(74) *Attorney, Agent, or Firm*—Klaus J. Bach

(57) ABSTRACT

In a fuel injection valve for a pump-line-injector system of an internal combustion engine, comprising a fuel injector with a nozzle body, a nozzle needle longitudinally movably supported in the nozzle body between a seated nozzle closing position and a lift-off position assumed during fuel injection, the nozzle includes a fuel supply passage, a fuel drain passage, a connecting passage extending from the fuel supply passage to the fuel drain passage, and a spring-loaded pressure relief piston forming a control valve disposed in the path of the pressurized fuel from the fuel supply passage to the drain passage for controlling the pressure of the fuel supplied to the nozzle needle during fuel injection into a cylinder of the internal combustion engine.

4 Claims, 4 Drawing Sheets

FUEL INJECTION VALVE FOR AN INTERNAL COMBUSTION ENGINE

BACKGROUND OF THE INVENTION

The invention relates to a fuel injection valve of an injection pump-line-nozzle system provided for a Diesel internal combustion engine with an injector holder and an injection valve needle which is disposed in an injector body so as to be longitudinally movable against a force applied thereto by a compression spring and which is surrounded by a pressure chamber to which fuel to be injected is supplied via a fuel supply passage.

DE 44 41 603 A1 discloses such a pump-line-nozzle system wherein fuel is supplied from a fuel injection pump by way of a fuel line to a fuel injector.

MTZ Motortechnische Zeitschrift 57(1996)4, FIG. 17, further shows a fuel injection valve wherein a spring-biased nozzle needle is longitudinally movably supported in an injector body wherein it is surrounded by a pressure chamber to which a fuel supply line leads. The nozzle needle is engaged via a pressure pin by a pressure bolt on which a compression spring acts. With this so-called two-spring nozzle holder combination, a stepped injection can be achieved since first only one spring but later both springs are activated. In this way, a noticeable noise reduction can be achieved.

It is the object of the present invention to provide a fuel injection valve with which, by appropriate control of the fuel return, the $NO_x$ emissions of the engine and also the generation of noises can be reduced.

SUMMARY OF THE INVENTION

In a fuel injection valve for a pump-line-injector system of an internal combustion engine comprising a fuel injector with a nozzle body, a nozzle needle longitudinally movably supported in the nozzle body between a seated nozzle closing position and a lift-off position assumed during fuel injection, the nozzle includes a fuel supply passage, a fuel drain passage, a connecting passage extending from the fuel supply passage to the fuel drain passage, and a spring-loaded pressure relief piston forming a control valve disposed in the path of the pressurized fuel from the fuel supply passage to the drain passage for controlling the pressure of the fuel supplied to the nozzle needle during fuel injection into a cylinder of the internal combustion engine.

With the pressure relief piston arranged in the return line so as to act as a control valve, a flow connection can be established during fuel injection between the fuel supply passage and the fuel return line returning fuel to the fuel tank for a short period whereby the fuel injection pressure can be lowered within a well-defined range of the pressure curve. As a result, the amount of fuel injected during that phase is reduced. In this way, the noise generation and the $NO_x$ emissions of the Diesel internal combustion engine as well as the fuel consumption can be positively influenced.

The invention will be described below in greater detail on the basis of the accompanying drawings.

DESCRIPTION OF PREFERRED EMBODIMENTS

Figure 1:
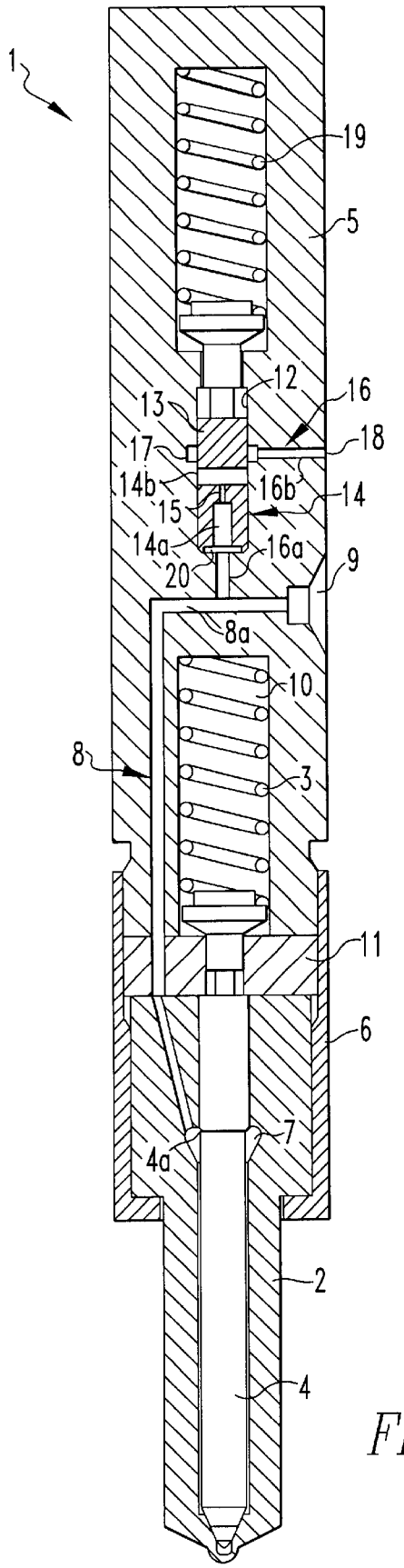
FIG. 1 shows a fuel injector according to the invention with a pressure-controlled pressure relief valve.

A fuel injector 1 for a pump-line-nozzle system, which is not shown in detail but which is commonly used in connection with Diesel internal combustion engines, comprises a nozzle body 2 including a nozzle needle 4, which is axially movably disposed in the nozzle body 2 against the force of a spring 3. The injector further comprises a nozzle holder 5, which is mounted to the nozzle body 2 by means of a nozzle clamping unit 6.

The nozzle needle 4 includes a pressure shoulder 4*a*, which is surrounded by a pressure chamber 7, that is in communication with a pressurized fuel supply passage 8. Between the inlet end 9 at the nozzle holder 5 above the spring chamber 10, which receives the compression spring 3 engaging the nozzle needle 4 and the pressure chamber 7, the fuel supply passage 8 extends first transversely through the body 2 and then parallel to the axis of the nozzle holder 5 and an intermediate disc 11 and finally at an angle down to the pressure chamber 7.

The nozzle holder 5 includes a cylindrical bore 12 in which a spring-loaded pressure relief piston 13 with a passage structure 14 is disposed so as to be longitudinally movable therein. The passage structure 14 includes a central bore 14*a* with a throttle 15 and a transverse bore 14*b* in communication with the central bore 14*a*.

The cylindrical bore 12 is in communication with the transverse section 8*a* of the fuel supply passage 8 by way of a first passage section 16*a* of a return passage 16, wherein the first passage section 16*a* extends coaxially with central bore 14*a*.

The cylindrical bore 12 includes an annular control groove 17 from which a second passage section 16*b* extends transversely through the nozzle holder up to the discharge side 18 to which a fuel return line is connected, which, however, is not shown in detail.

The pressure relief piston 13, which acts as a control valve is biased onto its seat 20 by a compression spring 19. This position is the basic position of the pressure relief piston 13, wherein the transverse bore 14*b* of the pressure relief piston 13 is disposed slightly below the control groove 17 which cooperates with the transverse bore 14*b*.

Figure 2:
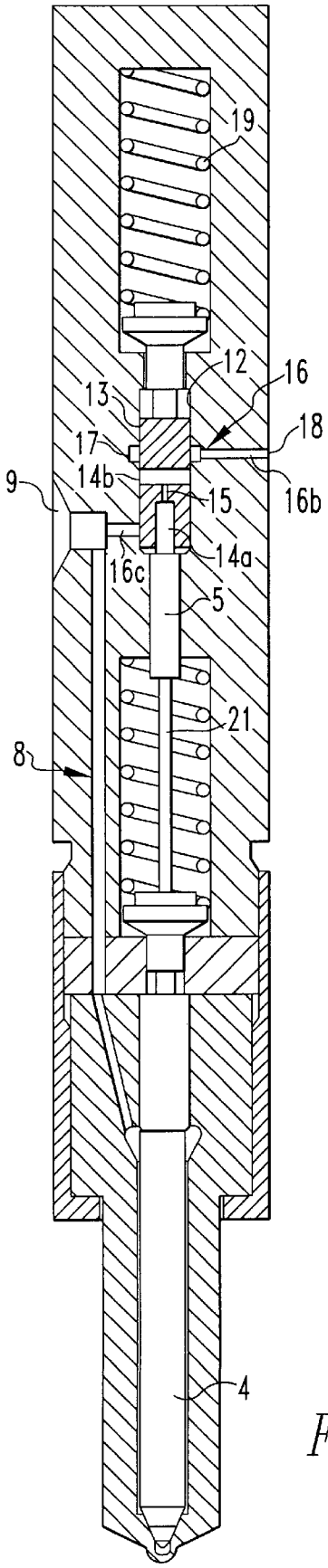
FIG. 2 shows a fuel injector according to the invention with a mechanically controlled pressure relief valve.

In the fuel injector 1 according to FIG. 2, an operating rod 21 is disposed between the pressure relief piston 13 and the nozzle needle 4 for operating the pressure relief piston 13. From the inlet 9 of the pressurized fuel supply passage 8, a transverse first passage sections 16*c* of the fuel supply passage 8 extends sidewardly from the cylindrical bore 12 for communication with the inlet 9 in an area adjacent the seat 14*a* of the relief piston valve 13.

Operation of the Injector 1 Provided with the Pressure Relief Piston 13 in Accordance with FIG. 1 and 4*a*–4*c*

The pressurized fuel supplied by a fuel injection pump to the inlet 9 pressurizes the nozzle area of the fuel injector 1 as well as the underside of the pressure relief piston 13. At a predetermined pressure level, the nozzle needle 4 is lifted off the needle seat and the fuel injection begins. The pressure level and the beginning of the movement of the pressure relief piston is determined by the pre-tensioning force of the compression spring 19.

Figure 4C:
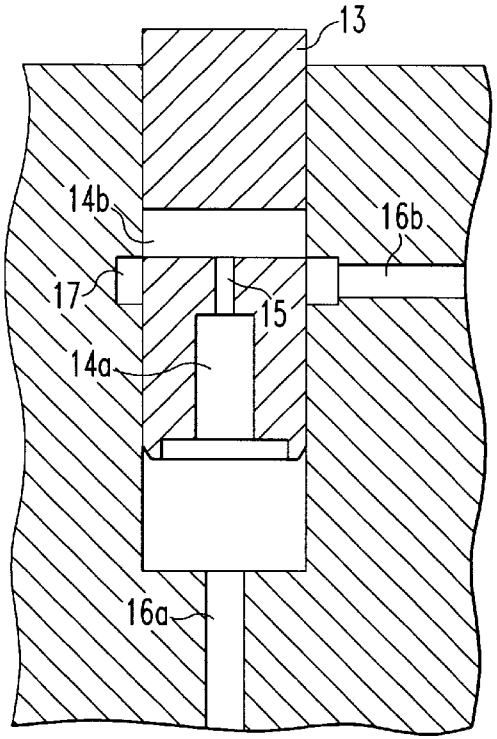
FIGS. 4*a*, 4*b*, and 4*c* are enlarged views showing the pressure relief valve in different positions.
Figure 4B:
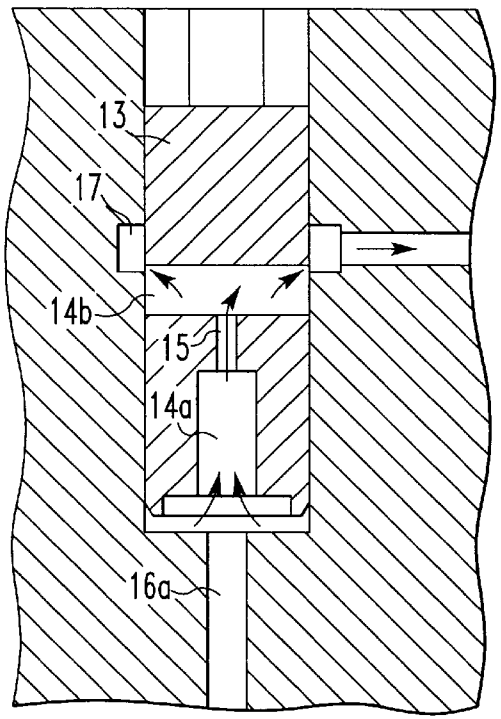
Figure 4A:
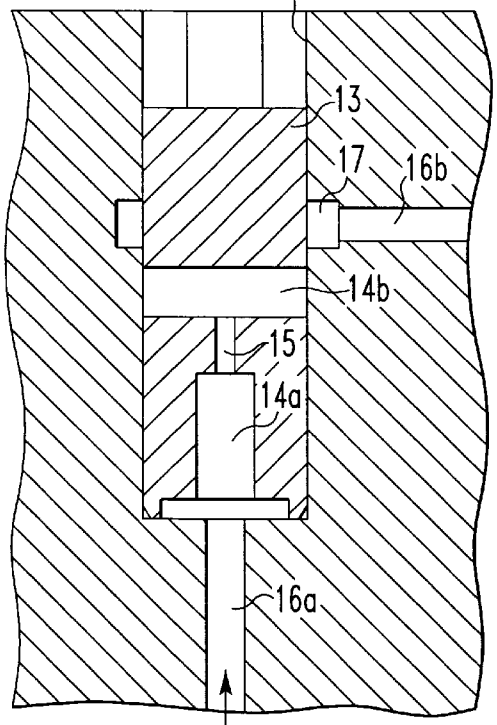

In the basic rest position of the pressure relief piston 13, the fuel return flow to the tank is interrupted (FIG. 1 and FIG. 4*a*). As soon as the movement of the pressure relief piston 13 begins, communication to the fuel return line is established by way of the transverse bore 14*b* and the control groove 17—after a predetermined idle travel distance (FIG. 4*b*). In this way, the pressure in the system is reduced dependent on the flow cross-section of the throttle 15, which is at the beginning of the fuel injection. At a certain piston travel distance of the pressure relief piston 13, the communication to the return line by way of the transverse passage 14*b* and the control groove 17 is interrupted and the phase of reduced pressure fuel supply is ended, (FIG. 4*c*) as the fuel discharge passage section 16*b* is blocked by the piston 13.

In FIG. 2, another embodiment of the invention is shown, wherein pressurization of the underside of the pressure relief piston 13 is initiated by the nozzle needle 4 by which the piston 13 is first lifted to initiate communication with the pressurized fuel supply by way of the passage section 16*c*. In this way, it is made sure that the fuel pressure curve is shaped only after the opening of the fuel injection nozzle. The compression spring 19 can be substantially softer in this embodiment.

Figure 3:
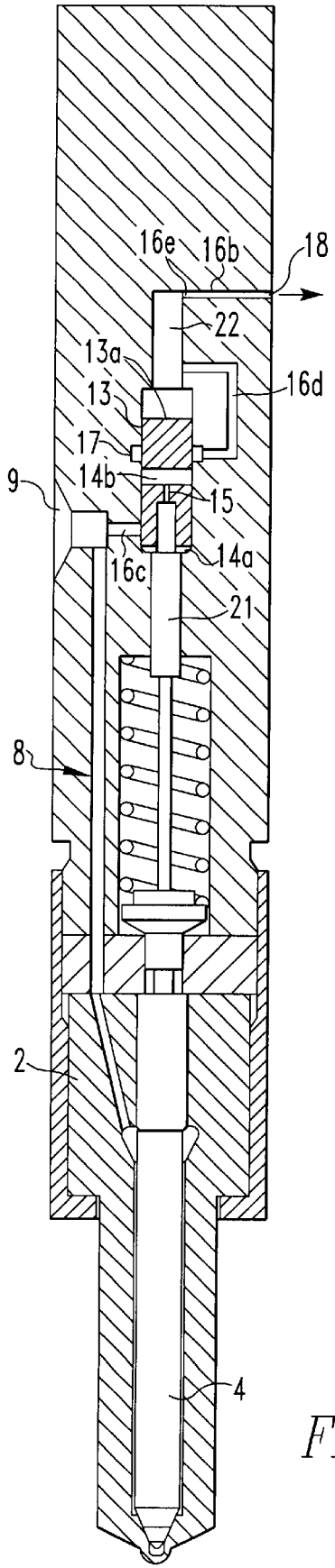
FIG. 3 shows another embodiment of the fuel injector according to the invention.

In the embodiment shown in FIG. 3, the return flow path from the control groove 17 to the fuel return line is somewhat different. With the additional throttle structure 16*e* used therein to conduct the fuel to the outlet 18, the lifting speed of the pressure relief piston can be controlled. Upon lifting of the piston 13, a pressurized fluid discharge flow path is established by way of the passage 16*d*.

What is claimed is:

1. A fuel injection valve for a fuel injection pump-line-nozzle system of an internal combustion engine comprising a fuel injector with a nozzle body, a nozzle needle supported in said nozzle body so as to be longitudinally movable therein between a seated nozzle closing position and a lift-off position, wherein fuel is ejected from the fuel injection valve, said nozzle body including a fuel supply passage for supplying fuel under pressure to said nozzle, a fuel drain passage for releasing fuel from said nozzle body, a connecting passage extending from said fuel supply passage to said fuel drain passage and a spring-loaded pressure relief piston forming a control valve disposed in the path of said pressurized fuel from said fuel supply passage to said fuel drain passage for controlling the pressure of the fuel supplied to said nozzle needle during fuel injection into a cylinder, said pressure relief piston including a passage arrangement by way of which the fuel supply passage is placed into communication with the fuel drain passage and a drain line for returning fuel to a tank when the injection pump generates a predetermined opening pressure, said passage arrangement in said pressure relief piston having a central bore including a throttle and a transverse bore extending transverse to the central bore, and the nozzle body includes an annular control groove cooperating with the transverse bore for returning fuel to the fuel tank when said pressure relief piston is moved a certain distance upon opening of the injection valve as a result of the pressure generated in the fuel supply passage.

2. A fuel injection valve according to claim 1, wherein said pressure relief piston has a base rest position wherein it is biased by said compression spring toward its seated position and delimits a pressure chamber which is in communication with the fuel supply passage by way of a first passage section of the drain passage which extends coaxially with a central bore in said pressure relief piston and wherein the drain passage includes a second passage section which extends radially outwardly from the annular control groove.

3. A fuel injection valve according to claim 1, wherein an operating rod is disposed between said pressure relief piston and said nozzle needle, and said pressure relief piston is spring-biased toward, and into engagement with, said pressure relief piston and wherein a first passage section extends from said fuel supply passage sidewardly to said pressure relief piston adjacent its sealed end and a second passage section extends from said annular control groove radially outwardly to a drain line for returning fuel to a tank.

4. A fuel injection valve according to claim 1, wherein an operating rod extends between the pressure relief piston and the nozzle needle for moving the pressure relief piston off its seated position when the nozzle needle is lifted, and wherein a first passage section of the drain passage extends from the fuel supply passage to an area of the relief piston adjacent its seated end and a second passage section of the drain passage, which extends from the annular control groove, is in communication with a low pressure chamber delimited by the pressure relief control piston and a passage section acting as a throttle extends from the low pressure chamber radially outwardly for returning fuel to a tank.

* * * * *